US005172572A

United States Patent [19]

Ono

[11] Patent Number: 5,172,572

[45] Date of Patent: Dec. 22, 1992

[54] AUTOMATIC WASHING APPARATUS

[75] Inventor: Shuzo Ono, Iwaki, Japan

[73] Assignee: Alps Electric Co., Ltd., Tokyo, Japan

[21] Appl. No.: 721,031

[22] Filed: Jun. 26, 1991

[30] Foreign Application Priority Data

Jul. 12, 1990 [JP] Japan ..... 2-182787
Jul. 12, 1990 [JP] Japan ..... 2-182788

[51] Int. Cl.[5] ..... D06F 33/02; A47L 15/46
[52] U.S. Cl. ..... 68/12.02; 134/57 D
[58] Field of Search ..... 68/12.01, 12.02, 12.27; 134/57 D, 113

[56] References Cited

FOREIGN PATENT DOCUMENTS 2022689 1/1987 Japan ..... 68/12.02
2149295 6/1990 Japan ..... 68/12.02

*Primary Examiner*—Philip R. Coe

*Attorney, Agent, or Firm*—Guy W. Shoup; David W. Heid; Patrick T. Bever

[57] ABSTRACT

An automatic washing apparatus for washing dirty things in a washing tank to which washing liquid is supplied, the automatic washing apparatus comprising: a light emitting element for emitting light to the washing liquid which has passed through the washing tank; a first light receiving element for receiving a linear light beam which travels through the washing liquid along the optical axis of the light emitting element; and a second light receiving element for receiving scattered light which travels through the washing liquid in directions deviated from the optical axis of the light emitting element, wherein washing conditions are controlled in accordance with the quantity of light received by the first light receiving element and the quantity of light received by the second light receiving element.

6 Claims, 3 Drawing Sheets

AUTOMATIC WASHING APPARATUS

BACKGROUND OF THE INVENTION

1. Field of the Invention

The present invention relates to an automatic washing apparatus such as a dish washing machine and a washing machine.

2. Description of Related Art

It is preferable that a dish washing machine or a washing machine be operated under the washing conditions such as the quantity of detergent to be injected, the washing time or the like which have been properly changed in accordance with the degree of contamination. However, ordinary conventional machines have been arranged in such a manner that a user previously sets the above-descrbed washing conditions.

However, a washing machine has been disclosed recently which is arranged in such a manner that the light transmissivity of washing water is measured by a means constituted by combining light emitting element and a light receiving element so as to estimate the density of the contamination particles, whereby the washing conditions can be controlled in accordance with the result of the estimation. The above-described conventional disclosure has been further arranged to be capable of estimating the degree of progress of the washing operation.

Since contamination of the things to be washed is classified into muddy contamination, contamination due to sweat, and oily contamination, the best washing conditions are different depending upon the type of the contamination. However, although the above-described conventional structures have been able to estimate the degree of contamination, the same have not been able to estimate the type of the contamination. In particular, since the suitable washing conditions are considerably different between leftovers (leavings) and oily contamination, it is significantly preferable to detect the type of the contamination so as to feed it back.

SUMMARY OF THE INVENTION

Accordingly, an object of the present invention is to provide an automatic washing apparatus capable of efficiently washing things to be washed in accordance with the degree and the type of the contamination.

In order to achieve the above-described object, according to one aspect of the present invention, there is provided an automatic washing apparatus for washing dirty things in a washing tank to which washing liquid is supplied, the automatic washing apparatus comprising: a light emitting element for emitting light to the washing liquid which has passed through the washing tank; a first light receiving element for receiving a linear light beam which travels through the washing liquid along the optical axis of the light emitting element; and a second light receiving element for receiving scattered light which travels through the washing liquid in directions deviated from the optical axis of the light emitting element, wherein washing conditions are controlled in accordance with the quantity of light received by the first light receiving element and the quantity of light received by the second light receiving element.

According to another aspect of the present invention, there is provided an automatic washing apparatus for washing dirty things in a washing tank to which washing liquid is supplied, the automatic washing apparatus comprising: a first light emitting source for emitting light to the washing liquid which has passed through the washing tank; a second light emitting source for emitting light, which has a shorter wavelength than that of the light beams emitted from the first light emitting source, to the washing liquid; and a light receiving element for receiving the light emitted from the first light emitting source and that emitted from the second light emitting source before they have passed through the washing liquid, wherein washing conditions are controlled in accordance with the quantity of light emitted from the first light emitting source and the quantity of light emitted from the second light emitting source.

If the density of the contamination particles in the washing liquid is the same, the extent of the scattered light in the washing liquid is changed in accordance with the size of the contamination particle. Specifically, the extent of the scattered light is reduced if the size of the contamination particle is large as in the case of the leftovers. On the other hand, the extent of the scattered light is large if the size of the contamination particle is small as in the case of oil in which emulsification has progressed. Therefore, according to the first aspect of the present invention, the size of the contamination particle can be estimated as well as the density of the same by making a comparison between the quantity of light received by the first light receiving element and that received by the second light receiving element. By feeding back the results of the above-described estimation, the efficient washing conditions can be set.

If the density of the contamination particles in the washing liquid is the same, the light transmissivity changes in accordance with the wavelength of the transmitted light and the size of the contamination particle. Specifically, long wavelength light possesses higher light transmissivity than short wavelength light. Furthermore, if the size of the contamination particle is small as in the case of oil in which emulsification has progressed, the light transmissivity is raised. Therefore, according to the second aspect of the present invention, the size of the contamination particle can be estimated as well as the density of the same by making a comparison between the quantity of received light emitted from the first light emitting source and that emitted from the second light emitting source. By feeding back the results of the above-described estimation, the efficient washing conditions can be set.

Other and further objects, features and advantages of the invention will be appear more fully from the following description.

BRIEF DESCRIPTION OF THE DRAWINGS

All of the accompanying drawings illustrate the embodiments of the present invention.

DESCRIPTION OF THE PREFERRED EMBODIMENTS

Figure 4:
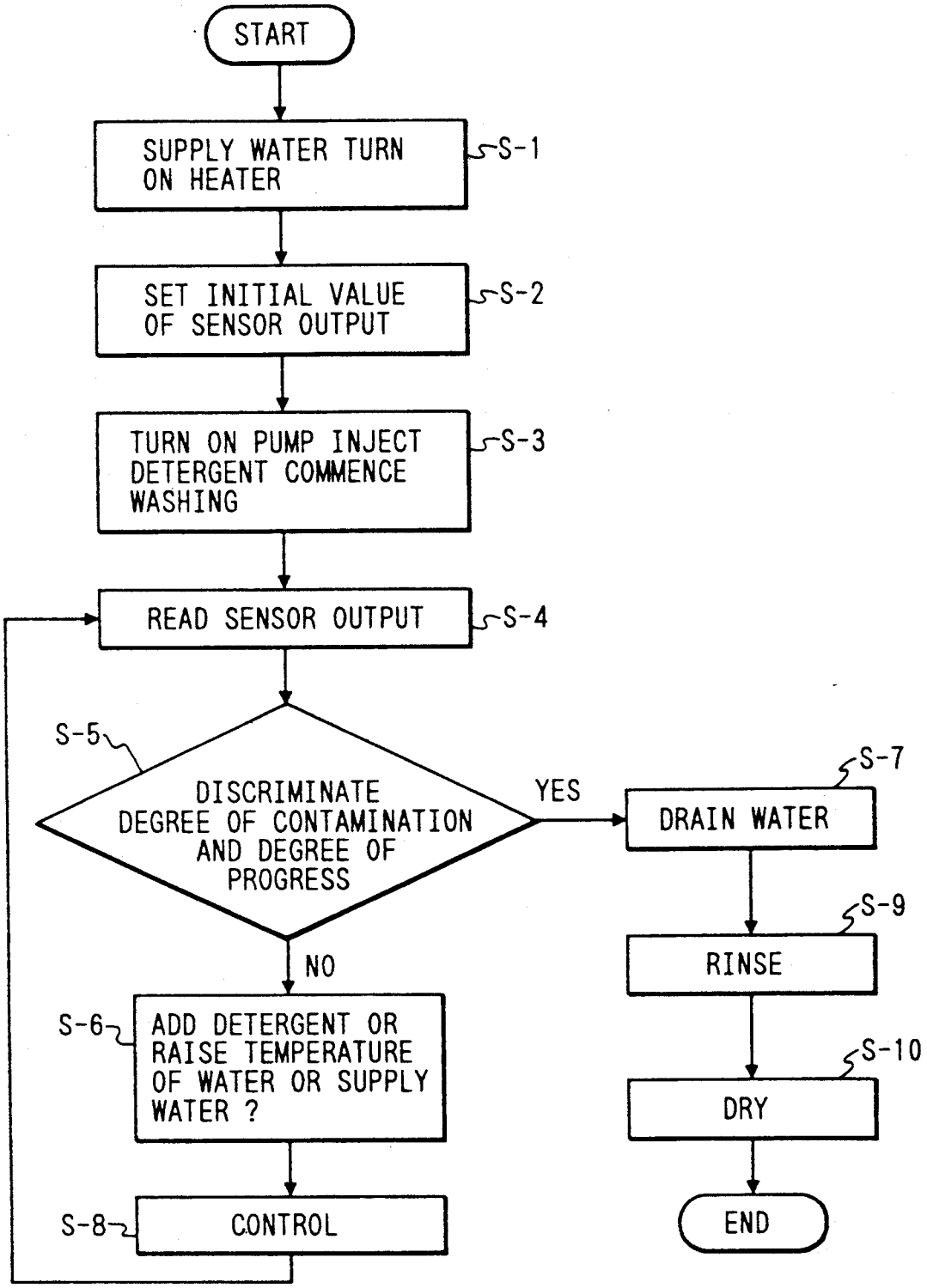
FIG. 4 is a flow chart which illustrates the operation of the dish washing machine.

A first embodiment of the present invention will now be described with reference to FIGS. 1, 2 and 4.

Figure 1:
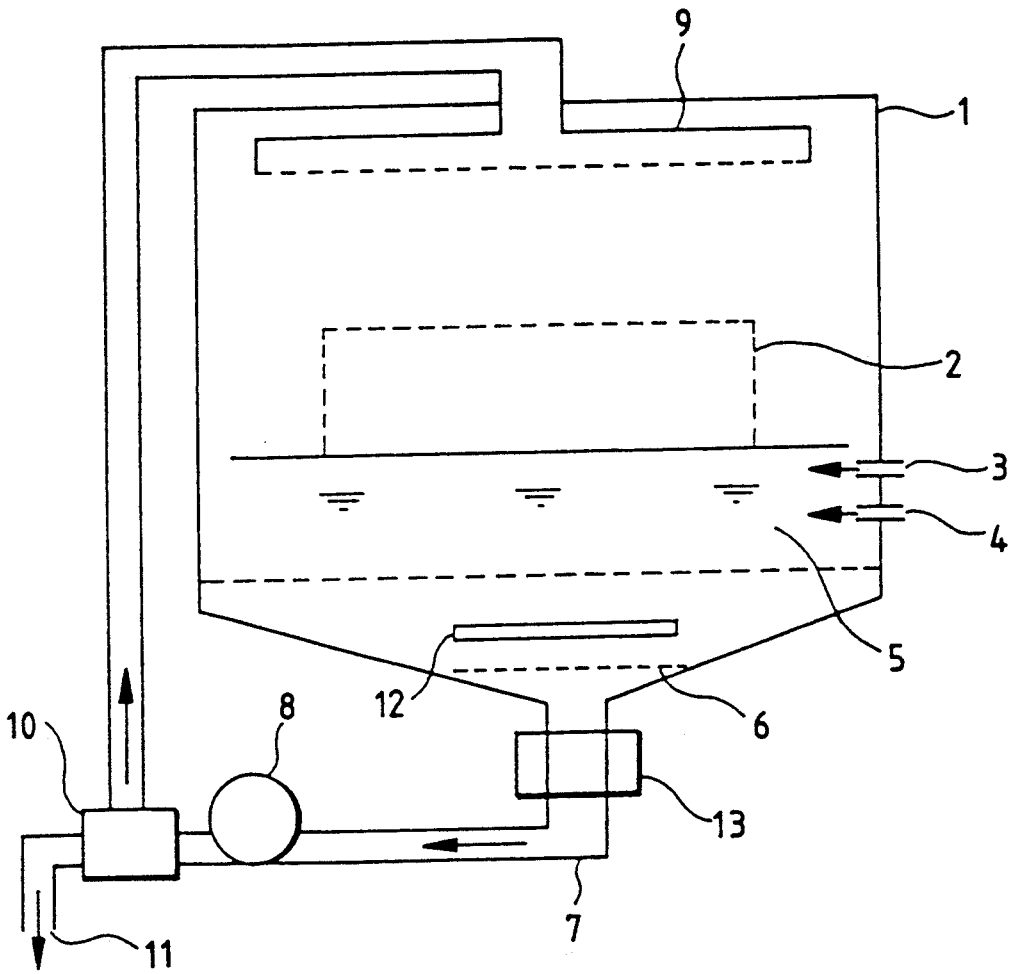
FIG. 1 illustrates the overall structure of a dish washing machine.

FIG. 1 illustrates the overall structure of a dish washing machine according the first embodiment of the present invention. FIG. 2 illustrates the basic structure of a sensor portion of the dish washing machine. FIG. 4 is a flow chart which illustrates the operation of the dish washing machine.

Figure 2:
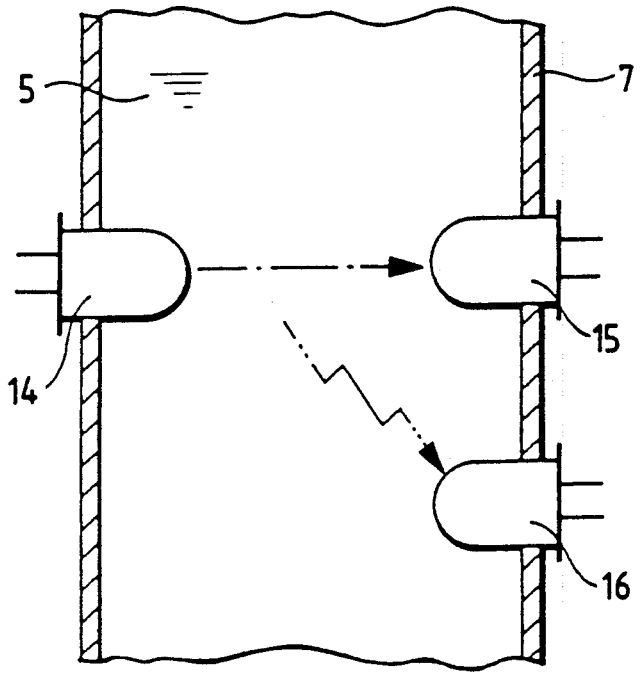
FIGS. 2 and 3 illustrate the basic structure of a sensor portion of the same.

Referring to FIGS. 1 and 2, reference numeral 1 represents a washing tank. Things 2 to be washed such as dirty dishes are injected into the washing tank 1 before the things 2 to be washed are washed in washing liquid 5 which is the mixture of water supplied through a water supply port 3 and detergent supplied through a detergent support port 4. The washing liquid 5 discharged from the washing tank 1 into a circulation pipe 7 after it has passed through a filter 6 is driven by a pump 8 so that it is again supplied to an atomizer 9 included in the washing tank 1. The washing liquid 5 can be discharged outside the apparatus through a discharge port 11 by switching a switch valve 10. Furthermore, a heater 12 is built in the bottom portion of the washing tank 1 so that the washing liquid 5 can be heated if necessary.

Reference numeral 13 represents a sensor portion which is, as shown in FIG. 2, arranged in such a manner that a first light receiving element 15 comprising a phototransistor is disposed in front of the light emitting element 14 made of an LED via the washing liquid 5 present in the circulating pipe 7. Furthermore, a second light receiving element 16 also comprising a photo-transistor and having the same sensitivity as that possessed by the first light receiving element 15 is disposed diagonally in front of the light emitting element 14. The output values from the two light receiving elements 15 and 16 are distinguished from each other in synchronization with the light emitting element 14 which is operated by a transmitting circuit (omitted from illustration), the distinguished two outputs being then converted into digital values so as to be transmitted to a comparator (omitted from illustration) which calculates the transmitted digital values. The first light receiving element 15 is provided for the purpose of receiving a linear beam which travels through the washing liquid 5 along the optical axis of the light emitting element 14. The second light receiving element 16 is provided for the purpose of receiving scattered light which travels through the washing liquid 5 while being scattered in a direction deviated from the optical axis of the light emitting element 14.

Then, the operation of the above-described dish washing machine according to the first embodiment of the present invention will now be described with reference to FIG. 4.

First, things 2 to be washed are injected into the washing chamber 1 before water is supplied through the water supply port 3 and the heater 12 is turned on (S-1). Then, the linear beam emitted from the light emitting element 14 travelling in fresh water, which is not positioned in contact with the things 2 to be washed, is received by the first light receiving element 15 so as to set the initial value (S-2). Then, the pump 8 is turned on and as well as the detergent is supplied through the detergent supply port 4 so that the washing operation is started (S-3). Subsequently, the linear beam and the scattered light, which travel through the washing liquid 5 which is the mixture of water and the detergent, are respectively received by the first light receiving element 15 and the second light receiving element 16 (S-4). The values output from the above-described two light receiving elements 15 and 16 are converted into digital values before they are transmitted to the comparator so that the degree of contamination and the degree of progress of the washing operation are discriminated (S-5).

That is, assuming that the quantity of light received by the first light receiving element 15 is A and the quantity of light received by the second light receiving element 16 is B, the value of A is reduced when the density of the contamination particles in the washing liquid 5 is raised. Since the quantity of change in the value of A depending upon the size of the contamination particle is small at this time, the density of the contamination particles can be obtained from the value of A. If the density of small contamination particles such as oil contamination, in which the degree of emulsification has progressed, is raised, the quantity of scattered light increases, causing the value of B to be enlarged. For example, if the value of A is small and as well as the value of B is large, a determination can be made that the density of large size particles is high and as well as the density of small size particles is low. If the values of both A and B are small, a determination can be made that the densities of both the large size particles and the small size particles are high. Therefore, by making a comparison between the value of A and the value of B, the density of the contamination particles in the washing liquid 5 and the ratio of the particles having different particle sizes can be estimated. The above-described calculation process can be performed by utilizing data items sequentially transmitted to a storing device (omitted from illustration).

Furthermore, the degree of progress of the washing operation can be estimated by calculating the rate of change in the value of B/A per unit time. That is, when the emulsification of oil progresses, the value of B/A becomes reduced. Therefore, a determination can be made that oil has been completely emulsified in a case where the particle size of the contamination particle is small and the change in the value of B/A is stopped.

After the degree of the contamination and the degree of the progress of the washing operation have been discriminated, the flow advances to S-6 or S-7 in accordance with the result of the discrimination. That is, if a discrimination has been made that the value of B/A is being changed or if a discrimination has been made that oil has not been completely emulsified although the value of B/A is not being changed, the flow advances to S-6. If it has been discriminated in step S-6 that, for example, the density of the contamination particles is high, a command to add the washing liquid 5 is issued. If it has been discriminated in step S-6 that the proportion of the unemulsified oil is large, a command to add the detergent or to raise temperature is issued. In accordance with the command thus-issued, the washing conditions are controlled (S-8) before the flow returns to step S-4 in which the quantity of light received by the sensor portion 13 is measured.

On the other hand, if a determination is made in step S-5 that the value of B/A is not changed and as well as oil has been completely emulsified, a determination is made that the washing operation has been completed and thereby the washing liquid 5 is discharged outside the apparatus (S-7). Then, water is newly supplied before rinsing is performed (S-9) and the things 2 to be washed is dried (S-10) so that all of the processes are completed.

Another arrangement may be employed in which the density of the contamination particles is estimated in accordance with only the quantity of light received by the first light receiving element 15. Furthermore, the size of the contamination particle is estimated from only the quantity of light received by the second light receiving element 16 in accordance with the density thus-estimated.

Then, a second embodiment of the present invention will now be described with reference to FIGS. 1, 3 and 4.

FIG. 1 illustrates the overall structure of the dish washing machine according the second embodiment of the present invention. FIG. 3 illustrates the basic structure of a sensor portion of the dish washing machine. FIG. 4 is a flow chart which illustrates the operation of the dish washing machine.

Figure 3:
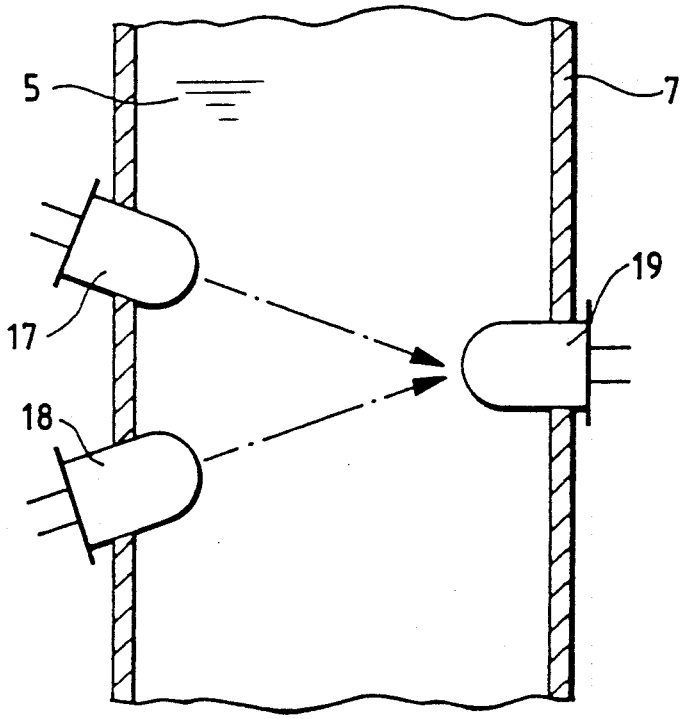

Referring to FIGS. 1 and 3, reference numeral 1 represents a washing tank. Things 2 to be washed such as dirty dished are injected into the washing tank 1 before the things 2 to be washed are washed in washing liquid 5 which is the mixture of water supplied through a water supply port 3 and detergent supplied through a detergent support port 4. The washing liquid 5 discharged from the washing tank 1 into a circulation pipe 7 after it has passed through a filter 6 is driven by a pump 8 so that it is again supplied to an atomizer 9 included in the washing tank 1. The washing liquid 5 can be discharged outside the apparatus through a discharge port 11 by switching a switch valve 10. Furthermore, a heater 12 is built in the bottom portion of the washing tank 1 so that the washing liquid 5 can be heated if necessary.

Reference numeral 13 represents a sensor portion which is, as shown in FIG. 3, arranged in such a manner that a first light emitting element 17 comprising an LED, which emits a red light beam, and a second light emitting element 18 comprising an LED, which emits a green light beam are disposed to confront a light receiving element 19 comprising a photo-transistor via the washing liquid 5. The above-described two light emitting elements 17 and 18 are alternately caused to emit light by a transmitting circuit (omitted from illustration). Furthermore, the output value from the light receiving element 19, which has been made to be in synchronization with the above-described light emission, is converted into a digital value before it is supplied to a comparator (omitted from illustration) so that it is processed.

Then, the operation of the above-described dish washing machine according to the second embodiment of the present invention will now be described with reference to FIG. 4.

First, things 2 to be washed are injected into the washing chamber 1 before water is supplied through the water supply port 3 and the heater 12 is turned on (S-1). Then, the quantity of red light received and that of green light received in fresh water, which is not positioned in contact with the things 2 to be washed, are measured so as to set the initial value (S-2). Then, the pump 8 is turned on and as well as the detergent is supplied through the detergent supply port 4 so that the washing operation is started (S-3). Subsequently, the quantity of red light received and that of green light received in the washing liquid 5, which is the mixture of water and the detergent, are measured (S-4). The results of the mesurement is converted into digital value before they are transmitted to the comparator so that the degree of contamination and the degree of progress of the washing operation are discriminated (S-5).

That is, assuming that the quantity of received light emitted form the first light emitting element 17 is R and the quantity of received light emitted from the second light emitting element 18 is G, a relationship $R>G$ is held due to the difference in the wavelength, both the value of R and that of G being lowered when the density of the contamination particles are raised. However, if the density is the same, the quantity of light received is, in particular in a case of red light, small if the size of the contamination particle is large as in the leftovers. If the size of the contamination particle is small as in oil in which emulsification has progressed, the quantity of light received is large. Therefore, the upper limit (if the particle size is small) of the density of the contamination particles and the lower limit (if the particle size is large) can be discriminated from the value of R. By making a comparison between the value of G, which corresponds to the particle size which is able to present in the above-described range, and the actual value of G, the density of the contamination particles in the washing liquid 5 and the particle size of the same can be estimated. The above-described calculation process can be performed by utilizing data items sequentially transmitted to a storing device (omitted from illustration).

Furthermore, the degree of progress of the washing operation can be estimated by calculating the rate of change in the value of G/R per unit time. That is, when the emulsification of oil progresses, the value of G/R becomes reduced. Therefore, a determination can be made that oil has been completely emulsified in a case where the particle size of the contamination particle is small and the change in the value of B/A is stopped.

After the degree of the contamination and the degree of the progress of the washing operation have been discriminated, the flow advances to S-6 or S-7 in accordance with the result of the discrimination. That is, if a discrimination has been made that the value of G/R is being changed or if a discrimination has been made that oil has not been completely emulsified although the value of G/R is not being changed, the flow advances to S-6. If it has been discriminated in step S-6 that, for example, the density of the contamination particles is high, a command to add the washing liquid 5 is issued. If it has been discriminated in step S-6 that the proportion of the unemulsified oil is large, a command to add the detergent or to raise temperature is issued. In accordance with the command thus-issued, the washing conditions are controlled (S-8) before the flow returns to step S-4 in which the quantity of light received by the sensor portion 13 is measured.

On the other hand, if a determination is made in step S-5 that the value of G/R is not changed and as well as oil has been completely emulsified, a determination is made that the washing operation has been completed and thereby the washing liquid 5 is discharged outside the apparatus (S-7). Then, water is newly supplied before rinsing is performed (S-9) and the things 2 to be washed is dried (S-10) so that all of the processes are completed.

Another arrangement may be employed in which the density of the contamination particles is estimated in accordance with only the quantity of received light emitted from either of the light emitting elements and the size of the contamination particle is estimated from only the quantity of received light emitted from the other light emitting element in accordance with the density thus-estimated.

Although according to the above-described embodiment, the description has been made about the structure in which the first light emitting element 17 which transmits red light beams and the second light emitting element 18 which transmits green light beams are used as the light sources, the present invention is not limited to the above-described embodiment. For example, a structure may be employed in which one light emitting element and different filters having wavelength selectivity are used so that different light emitting sources are formed. As an alternative to this, three or more light emitting sources (light emitting elements) for emitting different wavelengths may be employed.

Furthermore, the present invention can, of course, be adapted to a washing machine as well as to the dish washing machine.

As described above, according to one aspect of the present invention, the washing conditions are controlled in accordance with the quantities of light respectively received by the two types of light emitting elements which respectively receive the linear beams and scattered light.

Furthermore, according to another aspect of the present invention, the washing conditions are controlled in accordance with the quantities of a plural types of light beams having different wavelengths.

According to the present invention, an excellent effect can be obtained such that the quantity of the contamination particles can be estimated from the particle size as well as the advantage obtainable in that the density of the contamination particles in the washing liquid can be estimated. Furthermore, the results of the estimation is fed back so that the excellent washing conditions can be set. Consequently, a significant practical advantage can be obtained.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An automatic washing apparatus for washing dirty things in a washing tank to which washing liquid is supplied comprising:

light emitting means for emitting light to said washing liquid which has passed through said washing tank;

light receiving means for receiving light generated from said light emitting means and passed through said washing liquid;

sensing means for sensing variation of stain concentration and stain quality in said washing liquid in response to an output signal from said light receiving means; and control means for discriminating a progress of stain of said washing liquid under a comparison between an output value from said sensing means and a stain initial value of said washing liquid and controlling a washing condition.

2. An automatic washing apparatus according to claim 1 characterized in that said stain concentration is discriminated in reference to an amount of stained particles and said stain quality is discriminated in reference to a particle diameter of stain.

3. An automatic washing apparatus according to claim 1 characterized in that said light emitting means is comprised of a first light emitting source and a second light emitting source for generating a light having a shorter wave-length than that of said first light emitting source and variation of said stain concentration and stain quality are detected in response to an amount of light received by said light receiving means generated from said first light emitting source and an amount of light received by said light receiving means generated from said second light emitting source.

4. An automatic washing apparatus according to claim 3 characterized in that said stain concentration is discriminated in reference to an amount of stained particles and said stain quality is discriminated in reference to a diameter of stained particle.

5. An automatic washing apparatus according to claim 1 in which said light receiving means is comprised of a first receiving element for receiving a linear advancing light passing in said washing liquid along an optical axis of the light emitting means and a second light receiving element for receiving scattered light dispersed out of the optical axis of said light emitting means and passing in said washing liquid characterized in that variations of said stain concentration and stain quality are detected in response to an amount of receiving light of said first light receiving element and an amount of receiving light of said second light receiving element.

6. An automatic washing apparatus according to claim 5 characterized in that said stain concentration is discriminated in response to an amount of stain particles and said stain quality is discriminated in response to a diameter of stain particle.

* * * * *